United States Patent [19]

Nellen

[11] Patent Number: 4,497,331

[45] Date of Patent: Feb. 5, 1985

[54] TOBACCO PRODUCT WITH HIGH FILLING POWER AND PROCESS OF MAKING SAME

[75] Inventor: William J. Nellen, West Hartford, Conn.

[73] Assignee: TMCI, Inc., South Windsor, Conn.

[21] Appl. No.: 407,081

[22] Filed: Aug. 11, 1982

[51] Int. Cl.[3] ..... A24B 3/14

[52] U.S. Cl. ..... 131/353; 131/355; 131/370

[58] Field of Search ..... 131/353–359, 131/369–375, 364

[56] References Cited

U.S. PATENT DOCUMENTS

| | | | |
|---|---|---|---|
| 865,012 | 9/1907 | Butler | 131/353 |
| 2,433,877 | 1/1948 | Wells et al. | 131/352 |
| 2,445,338 | 7/1948 | Sowa | 131/352 |
| 2,592,554 | 4/1952 | Frankenburg | 131/352 |
| 2,626,612 | 1/1953 | Pearce | 131/357 |
| 2,734,510 | 2/1956 | Hungerford et al. | 131/354 |
| 3,430,634 | 3/1969 | Schweitzer et al. | 131/353 |
| 3,477,440 | 11/1969 | Licis | 131/350 |
| 4,109,665 | 8/1978 | Godfrey, Jr. et al. | 131/353 |
| 4,258,728 | 3/1981 | Cogbill | 131/140 |

FOREIGN PATENT DOCUMENTS

| | | | |
|---|---|---|---|
| 867826 | 5/1961 | United Kingdom | 131/354 |

OTHER PUBLICATIONS

Chemical Abstracts (subject matter), vols. 66, 74, 75, 84, 94.

*Primary Examiner*—V. Millin

*Attorney, Agent, or Firm*—Edmund M. Jaskiewicz

[57] ABSTRACT

A tobacco product with a high specific volume and particularly suited for use as cigarette or cigar filler produced by laminating together two sheets of reconstituted tobacco sheet under conditions so that the resulting laminate, after shredding, contains shreds in which the plies are only partly adhered and partly separated, whereby a filler having substantially increased filling power is produced as compared with conventional reconstituted tobacco sheet.

10 Claims, 16 Drawing Figures

TOBACCO PRODUCT WITH HIGH FILLING POWER AND PROCESS OF MAKING SAME

BACKGROUND OF THE INVENTION

This invention relates generally to the use of reconstituted tobacco sheet as a filler material to be used in admixture with leaf tobacco in smoking materials such as cigarettes and cigars. This invention relates particularly to a method of improving the property known as filling power. This invention also relates to making tobacco products for other uses which after shredding have superior shred length and shred resiliency.

Cigarette filler is produced by cutting tobacco leaf or reconstituted tobacco sheet into shreds or pieces about 0.03 inches or less wide and of varying length, typically averaging 8 mm or longer. These shreds are packed into a cigarette under controlled compressive forces. The specific volume of the cigarette filler, measured at a controlled moisture content of about 13%, indicates the filling power.

In the production of cigar filler a machine is used to thresh the sheet into smaller fragments of irregular dimensions and with an average size similar to about 10 mm square. Such fragments of cigar filler are incorporated into the cigars without the subsequent cutting into narrow shreds as used in cigarette filler.

Chewing tobacco and snuff are examples of non-smoking tobacco products which can be sold as shredded products and which benefit from improvements in the length and resiliency of the resulting shreds.

Reconstituted tobacco sheet, conventionally is produced by the so-called band processes or by the paper machine process. The band processes involve applying a dispersion of tobacco particles, in combination with other additives and adhesives, to a metal carrier belt where the dispersion is dried and it thereby becomes a sheet which is peeled off the belt. The typical thickness of such a dried sheet is 0.006 to 0.008 inches. Such band processes are well known and have been described by Jansson and Lilja in U.S. Pat. No. 3,162,200, by Pihl in U.S. Pat. No. 2,971,517, by Gretz in U.S. Pat. Nos. 3,590,493 and 3,589,032, by Egri in U.S. Pat. Nos. 3,894,544 and 4,069,831, by Schmidt and Hoge in U.S. Pat. No. 4,306,578, and by Schmidt in U.S. Pat. No. 4,325,391.

The tobacco sheet can also be produced on a paper machine where water is drained from a fibrous slurry of tobacco particles, and the web or sheet may be subsequently treated with additives and dried. Such paper machine processes have been described by Selke in U.S. Pat. Nos. 3,860,012 and 4,182,349, and by Arledter and Marek in U.S. Pat. No. 3,870,054.

There have been various efforts to improve the filling power of tobacco sheet. A process for the non-uniform compacting of tobacco sheet by a specialized belt treatment was described by Licis in U.S. Pat. No. 3,431,915. Schweitzer in U.S. Pat. No. 3,430,634 described a process for creping a tobacco sheet by applying the moist tobacco sheet to a creping roll and doctoring it from the creping roll. Cogbill in U.S. Pat. No. 4,258,728 described a process which involves simultaneous steaming, wrinkling and shattering of tobacco sheet to improve filling power. Other processes for increasing the filling power of tobacco sheet have incorporated air or foam-generating agents in the wet sheet for the purpose of achieving a final structure of lower density and higher specific volume.

Laminations of two layers of tobacco sheets have been used heretofore to create visual effects such as to simulate the vein structure of natural tobacco leaf in cigar wrappers. and this was described by Godfrey et al in U.S. Pat. No. 4,109,665 and by Sinclair et al in U.S. Pat. No. 4,135,962. Conventional laminations where two or more plies of reconstituted tobacco sheet are continuously and intimately connected have not found advantage to produce a cigarette or cigar filler having improved filling power.

Reconstituted tobacco sheet made by one of the band processes always tends to have one particularly smooth surface, which results from the smoothness of the metal belt on which it was formed. The smooth surface has certain disadvantages. The smooth surface can cause chopped pieces to experience slippage on inclined belt conveyors. Also, if the moisture content of a band-formed tobacco sheet exceeds about 18% or more, and if the 5 cm cut squares of tobacco sheet are randomly pressed together, such as in the bottom of large bulk shipping containers, there is a tendency for the pieces to form larger clumps of irregularly cohering pieces, with such clumps often containing ten or more individual plies. Such thick clumps, when passing through the shredding machine, result in thicker shreds, which resemble miniature logs, and such shreds have lower specific volume and lower filling power.

Tobacco sheet made by the paper machine process can also form unwanted laminations. Such unwanted sheet structure generally is brought about by a high localized surface concentration of tobacco extractives which are reintroduced into the tobacco sheet after the fibrous web has been formed.

The ideal reconstituted tobacco sheet would be visually indistinguishable from leaf tobacco. However, most sheet products are very two-sided and therefore readily identifiable. This effect is more pronounced with band-formed sheet than with sheet made by the paper machine process.

OBJECTIVES OF THE INVENTION

It is an object of the present invention to provide a process for substantially increasing the filling power of reconstituted tobacco sheet.

Another objective of this invention is to produce a cigarette or cigar filler with enhanced filling power from a reconstituted tobacco sheet product. Further objectives are to eliminate slipperiness, to overcome any tendency of moistened sheets to self-laminate, and to produce a cigarette or cigar filler which has an appearance similar to the cigarette or cigar filler made from natural leaf tobacco.

Another objective of this invention is to produce a laminate of tobacco sheets which can be subsequently shredded into non-smoking tobacco products such as chewing tobacco or snuff, whereby such tobacco products contain shreds of improved length and resiliency.

DESCRIPTION OF THE INVENTION

During the course of routine experimental work it was unexpectedly observed that laminates made from two plies of reconstituted tobacco sheet can be used to produce cigarette filler with distinctly improved properties. The filling power is enhanced, and the average length of shredded particles is increased. The resulting cigarette filler has an elastic resiliency which is superior to previously known products.

In order to obtain the improved results the two plies of reconstituted tobacco sheet must be bonded together in only a portion of their adjacent face-to-face surfaces. Such a two-ply laminate is one in which the adjacent sheet surfaces which appear to be contacting each other, are actually only intimately bonded together over a fraction of the total adjacent contacting area, so as to result in providing localized areas which are not bonded together. Such laminate structures are shown in the accompanying photographs and schematic drawings. A single sheet of reconstituted tobacco is shown as well as the various types of laminates produced when flat or creped single sheets are utilized to provide laminate structures. The tobacco shreds shown in these photographs were made on a shredding machine which forms cigarette filler shreds which approximate 1/32 inch in width.

With regard to the photographs and drawings.

Figure 5:
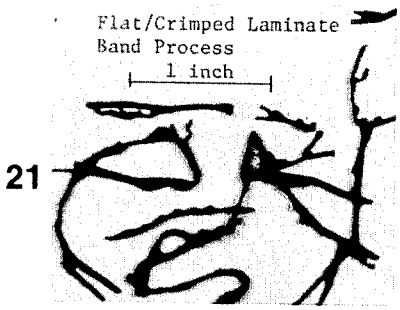
Figure 5A:
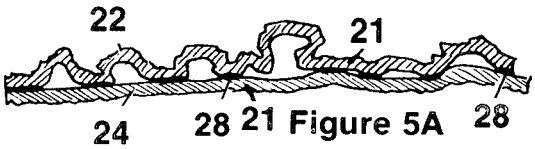
Figure 6:
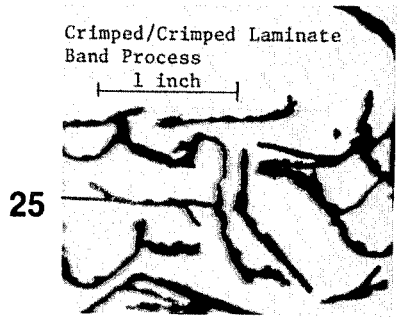
Figure 6A:
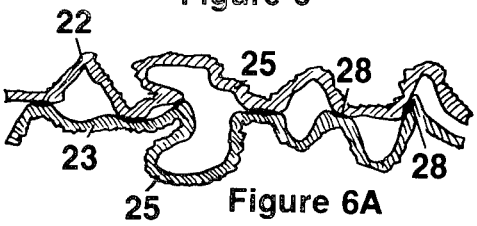

FIGS. 5 and 5A similarly show the structure of shreds from a partially bonded laminate made from one layer of flat, uncreped tobacco sheet and one layer of creped tobacco sheet;

FIGS. 6 and 6A similarly show the structure of shreds from a partially bonded laminate made from two layers of creped tobacco sheet. FIGS. 1 through 6A illustrate structures made by the band process.

FIGS. 7, 7A, 8 and 8A show the structure of shreds as made by the paper machine process.

Figure 1:
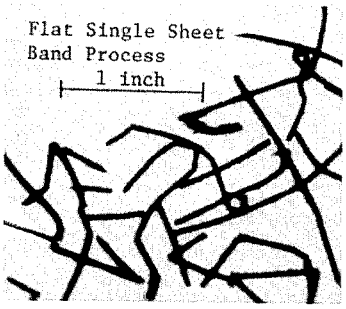
FIG. 1 shows shreds obtained when a single sheet of reconstituted tobacco in flat, uncreped form is shredded to provide cigarette filler.
Figure 1A:
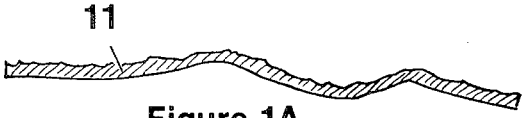
FIG. 1A is a partial cross-sectional view, enlarged, of a single reconstituted tobacco sheet in flat, uncreped form.
Figure 2:
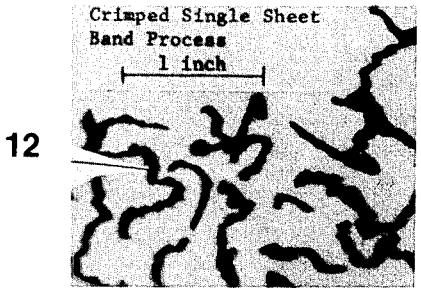
FIG. 2 shows shreds obtained when a single sheet of reconstituted tobacco in creped form is shredded to provide cigarette filler.
Figure 2A:
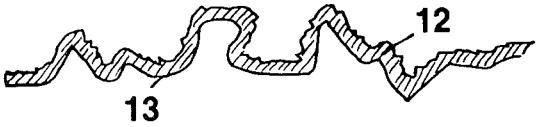
FIG. 2A is a partial cross-sectional view, enlarged, of a single reconstituted tobacco sheet in creped form.

Referring to FIGS. 1 and 1A the tobacco shreds 10 comprise long and narrow strips cut from a single sheet of reconstituted tobacco sheet 11. In FIGS. 2 and 2A the shreds 12 have a jagged shape from the creping operation and which make up the single sheet 13. The single-ply shreds shown in FIGS. 1 and 2 have a shorter average length than shreds made from laminates, as shown in other figures.

Figure 3:
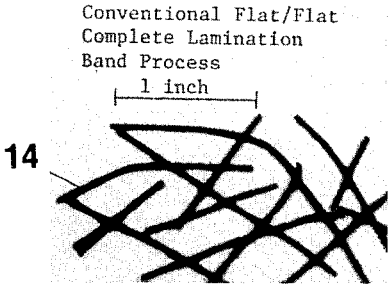
FIG. 3 shows shreds obtained by shredding a laminate wherein two flat, uncreped layers of reconstituted tobacco sheet are intimately bonded together throughout the adjacent contacting area.
Figure 3A:
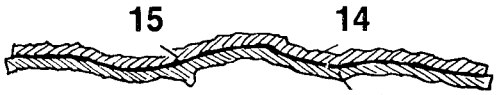
FIG. 3A is a partial cross-sectional view, enlarged, and illustrating the two-layer laminate with complete localized bonding between the layers.
Figure 4:
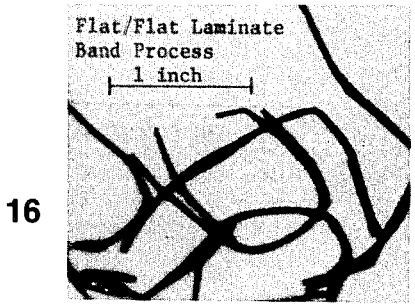
FIG. 4 shows shreds obtained by shredding a laminate wherein two flat, uncreped layers of reconstituted tobacco sheet are only partially bonded together in accordance with this invention.
Figure 4A:
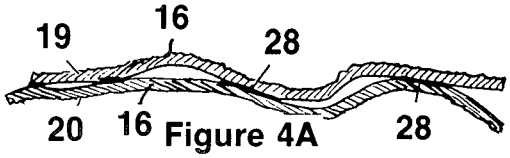
FIG. 4A is a partial cross-sectional view, enlarged, and illustrating the two-layer laminate with only partial bonding between the layers.

In FIG. 3 the shreds 14 are somewhat larger than single-ply shreds 10 and 12, and comprise the laminate 15 as shown in FIG. 3A. Shreds 16, as shown in FIG. 4, make up the two layers 19 and 20 which layers are incompletely bonded together at spaced bonded areas 28. Such spaced bonded areas are so designated in FIGS. 4 through 7, and constitute an essential feature of my inventive discovery.

FIGS. 5, 5A, 6 and 6A show the result when the reconstituted tobacco sheet is formed by a band process and is doctored from the continuous metal belt at a moisture content of about 18%, which causes the sheet to become creped as at 21. Such a creped layer 22, as shown in FIGS. 5A and 6A, is laminated to uncreped layer 24 (FIG. 5A) or a second creped layer 23 (FIG. 6A) with formation of spaced bonded areas 28, after which the laminate is cut into small pieces, dried, and subsequently shredded to form cigarette filler.

Figure 7:
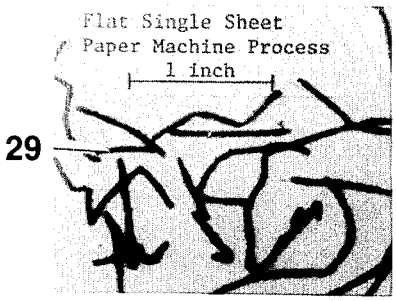
Figure 7A:
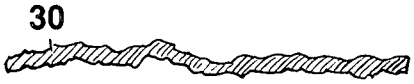
Figure 8:
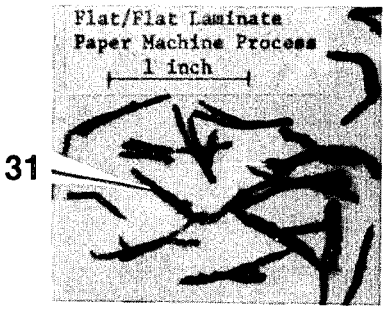
Figure 8A:
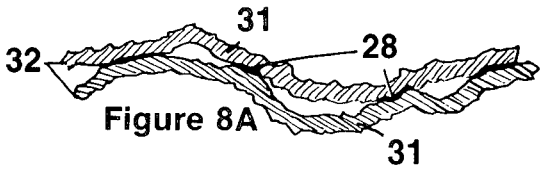

All the FIGS. 1 through 6 depict cigarette filler shreds from the tobacco sheet made by the band process, as aforementioned. FIGS. 7, 7A, 8 and 8A show photographs and cross-sectional enlarged view of shreds from tobacco sheet made by the paper machine process. FIG. 7 shows shreds 29 which made up the single-ply uncreped sheet 30 and FIG. 8 shows, the shreds 31 which made up the laminate 32 illustrated in FIG. 8A, and bonding 28 as heretofore described.

It is convenient to compare the cigarette filler shreds on the basis of the percentage of the length of the shred in which the two plies appear to be bonded together, based on visual inspecition. This is referred to as the Adherent Length Factor, and an Adherent Length Factor of 40% would mean that the average shred in that sample has about 40% of its length as two plies which appear to be conjoined.

In the two-ply sheet laminate illustrated in FIG. 3A, and wherein the adjacent surface areas are completely and firmly bonded together, the Adherent Length Factor approximates 100%. Such a two-ply laminate tobacco sheet structure has been found to be too stiff and lacks resiliency. Moreover, such laminate structure does not exhibit the improved filling power achieved by the present invention. The two-ply reconstituted tobacco sheet of partially laminated shreds shown in FIGS. 4A, 5A, 6A and 8A and where in the tobacco shreds are bonded at spaced areas, represent the preferred tobacco products made in accordance with this invention.

The following table shows the estimated Adherent Length Factors and the measured filling powers of the tobacco samples shown in the photographs of FIGS. 1 to 8.

ADHERENT LENGTH FACTORS AND FILLING POWERS

| | | Est. Adherent Length Factor | Filling Power cc/gram |
|---|---|---|---|
| FIG. 1. | Single-ply, flat, band process | — | 3.79 |
| FIG. 2. | Single-ply, creped, band pr. | — | 4.00 |
| FIG. 3. | Laminate flat/flat, complete bonding, band process | 95+% | 3.90 |
| FIG. 4. | Laminate flat/flat, partial bonding, band process | 30% | 4.10 |
| FIG. 5. | Laminate flat/creped, partial bonding, band process | 40% | 4.51 |
| FIG. 6. | Laminate creped/creped, partial bonding, band process | 25% | 4.51 |
| FIG. 7. | Single-ply, flat, paper machine process | — | 3.73 |
| FIG. 8. | Laminate flat/flat, partial bonding, paper machine process | 35% | 4.21 |

The process for making a tobacco filler in accordance with this invention comprises the following steps:

(a) forming a reconstituted tobacco sheet by applying a tobacco slurry mass on a metal or fabric supporting surface and drying the same;

(b) removing the resultant dried tobacco sheet from the supporting surface;

(c) laminating together pairs of the thus produced tobacco sheets in the case of sheet made by the band process the sides of the sheets which had been in contact with the metal bands disposed adjacent to each other, and in the case of sheets made by the paper machine process the sides of the sheets which had been opposite the forming wire disposed adjacent to each other, with the resulting laminate comprising spaced localized bonded and unbonded areas;

(d) cutting or threshing the laminate into cigar filler fragments or into shreds comprising two layers of reconstituted sheet, the resulting layers being adhered together for 10% to 60% of the area of the adjacent surfaces.

The specific results which are achieved from the use of this invention are affected by the sheet properties, the condition of the sheet when it is pressed against the adjacent sheet in the process of lamination, the pressure, duration and geometric patterm of the laminating step, and the conditions of subsequent cutting, drying, packing, remoistening and shredding or threshing.

The basis weight of the reconstituted sheet is not deemed to be critical, and a typical sheet weight is in the range of four to nine grams per square foot, measured on an oven-dry basis. The sheet can be flat or creped. The moisture content of the plies as they are pressed together has an important effect in achieving an adherent contact between the plies, both in softening the plies to make better contact and also in developing surface tackiness. If two reconstituted tobacco sheets made by the band process are laminated with their smooth sides together when the moisture content is in the range of 15% to 18%, there is usually no need for any additional laminating adhesive. The addition of a supplementary laminating adhesive, however, can be used. A suitable laminating adhesive for this purpose would be a solution of a modified cellulose gum such as methyl cellulose or a solution of a natural vegetable gum such as guar gum.

The actual merging of the two plies into a laminate can take place by passing the two sheets through a pressure nip of two contacting rolls in which the contact pressure and the surface characteristics of these laminating rolls are chosen to achieve the best results with the sheets to be laminated. The percentage of bonded area between the plies can be adjusted by using a raised pattern on one or both of the laminating rolls so as to insure that each resulting shred of cigarette filler will contain some localized length of pressure bonding lamination. The laminating can also take place without any pressure nip at all by preparing a stack of sheets in which the weight of the overlying sheets, with or without additional applied weights, will cause the lamination to take place with the resulting incomplete localized bonding between plies. The spacing or linear distance between the bonded areas may vary, preferably however, it is provided that the plies which make up the laminates of two reconstituted tobacco sheets of two layers are adhered together for 10% to 60% of the area of the two adjacent surfaces. When such laminates are shredded to form narrow cigarette filler shreds the two plies are adhered together for 10% to 60% of the length of the shreds. When such laminates are threshed to form irregularly shaped cigar filler fragments the two layers are adhered together for 10% to 60% of the length of a line connecting the opposite edges of the piece of cigar filler.

With proper precautions the laminates can be shipped and stored without loss in filling power. It is customary to laminate the two plies together at a moisture content of 15% to 18%, then cut the sheet into small pieces which are typically squares about 5 centimeters per side, and then to dry the squares to a moisture content of about 12% in a hot air dryer in which the individual pieces of laminate are permitted to cockle, twist and to partially delaminate in the localized areas where the laminating pressure was low and where little or no bonding was obtained. Such dried squares can be safely shipped and stored. Upon subsequent remoisturizing and shredding they form a cigarette filler with excellent filling power. Upon subsequent remoisturizing and threshing they form a cigar filler with excellent filling power.

In the preferred embodiment of this invention the laminating step is conducted without additional laminating adhesive by choosing the surfaces which are to be bonded together. When using tobacco sheet made by the band process it is preferred to bond together the two very smooth surfaces which have the greater tendency to develop tackiness when moist. By making the laminate in this manner, the dry slipperiness, the moist tackiness and the visible two-sidedness normally associated with the single-ply reconstituted tobacco sheets are thereby overcome. The same effect is achieved using tobacco sheets made by the paper machine process, by bonding together the felt sides of the sheets which tend to be tacky from the reintroduction of previously-extracted water-soluble tobacco components and those water-soluble materials are used to assist in firmly bonding the two-ply sheets together at spaced areas throughout the adjacent layer surfaces.

The estimation of filling power of cigarette filler is achieved in the following manner. Pieces of single-ply or laminated sheet material are brought to about 18% moisture content and allowed to equilibrate for at least 24 hours. They are then fed into a rotary disc shredder such as "Destroyit", an officetype paper shredding machine which has 32 cuts per inch, which is the standard U.S. cigarette shred width. The shredded material is allowed to equilibrate to a moisture content of 13%±1% by conditioning for 24 hours in an atmosphere of 62% relative humidity and 22° C. The specific volume (filling power) is checked with the Borgwaldt cylinder. The sample moisture content is checked and the specific volume is corrected by 0.22 cc/gram for each 1% moisture variation from 13%. The correction is added if moisture is higher than 13% and subtracted if below. This method is also useful for comparing the filling power of cigar fillers even though cigar fillers in commercial practice are threshed into irregular shaped pieces rather than into the long narrow shreds of cigarette filler.

The term "tobacco" as used herein includes tobacco, reconstituted tobacco and tobacco waste such as stems or fines. Moreover tobacco substitutes such as cocoa leaves and other naturally occuring or cultivated vegetation, tobacco-like substances, and similarly structured synthetic compositions well known in the art e.g., cellulose or cellulose derivatives are also intended to be within the scope of the present invention.

EXAMPLES OF THE INVENTION

Operation of the process as described in the following examples is intended to be merely illustrative of the invention, and is not to be regarded as limited thereto except as set out in the claims. The parts and percentages given are by weight unless otherwise stated.

EXAMPLE I

A reconstituted single tobacco sheet was made from a mixture of tobacco wastes including stems, winnowings, lamina and tobacco dusts. The tobacco mixture was comminuted to pass through an 80 mesh U.S. standard sieve. A baseweb dispersion, prepared to a solids content of 4%, comprised 25% bleached hardwood pulp, 25% raw tamarind gum, 33% cooked tamarind gum, 7% guar gum and 10% glyoxal. When the baseweb was combined with the tobacco, in a high-intensity mixer and at a ratio of 85% tobacco solids to 15% baseweb solids, a castable slurry was formed, and then cast into tobacco sheet by means of the band process. The sheet weight was 6 grams per square foot with a moisture content of 12%, providing a smooth uncreped sheet product. The sheet was then cut into 5 centimeter squares and shredded as indicated in the procedure for measuring filling power. The filling power was 3.79 cc/gram. A photograph of these shreds is included herein as FIG. 1.

Additional samples of the above single sheet material were remoistened to about 18% moisture content and then they were given additional fine atomized spray of water when they were stacked together in pairs. Each pair had the smooth sides of the sheets in face-to-face contact. A weight of about 75 pounds per square foot was then applied to the sheet material to cause the pair of single sheets to form a laminate in which the sheets were bonded together over practically all of their adjacent surfaces. The weight was placed on a stack of sheets and the sheets remained under that pressure overnight. The following day, the two-ply laminates were removed from the stack and permitted to air-dry as two-ply laminates. The laminates were then cut into 5 centimeter squares and shredded as indicated for measurement of filling power. The Adherent Length Factor was about 95% and the filling power was 3.90 cc/gram. The modest increase in filling power from 3.79 to 3.90 cc/gram is insufficient to justify a laminating step. A photograph of these shreds is included herein as FIG. 3.

Further additional samples of the same single sheet material as described above were laminated together in pairs. In this the moisture content was 18% and no additional water spray was used. Also, the weight on the laminated moist sheets was reduced to about 25 pounds per square foot. In other respects the laminating procedure was as described above. After air-drying the laminates were cut into 5 centimeter squares and shredded as indicated in the procedure for measuring filling power. The Adherent Length Factor was estimated to be about 30%. The filling power was 4.10 cc/gram, an improvement of 8% over the single-ply sheet. This is considered to be a worthwhile improvement. Shreds from this sample were used to make the photograph of FIG. 4.

EXAMPLE II

A creped reconstituted single sheet was made from cigarette wastes. The procedure was the same as in Example I except the sheet was doctored off the continuous metal bolt at a moisture content of about 18% and a creped reconstituted tobacco sheet was obtained. It was roughly estimated that the crimping had the effect of reducing the sheet length by about 50%. Samples of this creped material were permitted to air-dry without compression. The resultant sheet was then cut into 5 centimeter squares and shredded for measuring filling power. The filling power was 4.00 cc/gram. This sheet was then used to prepare additional laminated samples. This creped sheet, in its single-ply form is shown in the photograph of FIG. 2.

Two different types of laminates were made with this creped sheet, using the 18% moisture content and the laminating pressure of 25 pounds per square foot. The first laminate contained one ply of creped sheet and one ply of flat uncreped sheet which was previously described in Example I. This flat/creped laminate was evaluated as previously described. The Adherent Length Factor was estimated to be about 40%. The filling power was 4.51 cc/gram, a 19% improvement over the initial flat single-ply sheet. The shreds from this sample are shown in FIG. 5.

The second laminate contained two plies of the creped sheet. This creped/creped laminate was evaluated as previously described. The Adherent Length Factor was estimated to be about 25%. The filling power was 4.51 cc/gram, a 19% improvement over the initial single-ply flat uncreped sheet and an 11% improvement over the initial single-ply creped sheet. The shreds are shown in the photograph of FIG. 6.

EXAMPLE III

Samples were obtained of commercial reconstituted tobacco sheet made by the paper machine process for use as cigarette filler. The product was visibly two-sided, in that one side had a darker color. This darker color is believed to be attributable to the fact that previously extracted water-soluble materials from the tobacco had been reintroduced into the reconstituted sheet on that side. This single-ply sheet material was shredded and it had a filling power of 3.73 cc/gram. FIG. 7 shows a photograph of these shreds which have a more ragged appearance than shreds made from reconstituted tobacco sheet made by the band process.

A laminate was then made containing two plies of the tobacco sheet, positioned so the dark-colored sides contacted each other. The laminate was made by overnight pressing of the sheets at 18% moisture content and 25 pounds per square foot pressure, as previously described. The laminate was evaluated as previously described. The Adherent Length Factor was estimated to be 35%. The filling power was 4.21 cc/gram, a 12.8% increase over the filling power of the single-ply sheet. The shreds from this test are shown in FIG. 8.

Referring to the band process for making the laminated reconstituted tobacco sheet, the same comprises the comminuting of the tobacco to pass through an 80 mesh U.S. standard sieve, preparing an aqueous baseweb dispersion of about 4% total solids content containing as its primary ingredients 20% to 35% of hardwood pulp and 55% to 70% vegetable gums or gums made from modification of cellulose, combining the tobacco and the baseweb in a high-intensity mixer, applying the resulting tobacco mixture onto a moving continuous metal belt or band with a polished smooth surface, using a casting-knife device to achieve a layer of wet tobacco mixture of about 0.016 inches uniform thickness on the moving metal belt, advancing the wet layer of tobacco mixture into a drying section where steam is applied to the bottom of the metal belt and hot air is impinged onto the top tobacco layer, doctoring the dried tobacco mixture from the smooth metal belt and thereby obtaining reconstituted tobacco sheet with the one smooth surface which had been adjacent to the smooth metal belt and one rougher surface which had been dried without contacting an exterior surface, as hereinbefore described.

With respect to the paper machine process for making the laminated reconstituted tobacco sheet, this process comprises the maceration or comminuting of the tobacco, the use of water to extract the water-soluble fraction, the fortification of the residual fibrous material with wood pulp fibers, the application of the mixed fiber mass to a paper machine system where a sheet is formed on a moving fourdrinier wire, drainage of water through the wire, removal of the wet sheet from the fourdrinier wire, passing the sheet through a train of cylindrical steam-heated dryer rolls to remove most of the moisture from the sheet, applying to the sheet a concentrated solution of the previously extracted water-soluble tobacco fraction, and again drying the sheet.

Preferably, the laminate layers comprise smooth side surfaces which are face-to-face with each other in the middle of the laminate. In the examples illustrated in FIGS. 7A and 8A, however, both side surfaces of the layers forming the laminate are rough or irregular because they were made by means of the paper machine process.

What is claimed is:

1. A tobacco laminate which has been threshed or shredded for use as a tobacco filler material for cigarettes and cigars and other tobacco products, the laminate comprising two plies of reconstituted tobacco sheet material wherein the plies are adhered together at spaced areas.

2. A cigarette or cigar filler laminate, as defined in claim 1, wherein the two said plies are adhered together at spaced areas for 10% to 60% of the adjacent area of said layers of the laminate.

3. A shredded cigarette filler laminate, as defined in claim 1, wherein the said two plies are adhered together at spaced areas for 10% to 60% of the length of said shreds of the laminate.

4. A cigarette or cigar filler laminate as defined in claim 1, wherein the plies of said laminate are adhered together by the application of pressure to the laminate at said spaced areas whereby the plies of the laminate are incompletely bonded together.

5. A cigarette or cigar filler laminate, as defined in claim 1, wherein said plies of the laminate are incompletely bonded together at spaced areas by adhesive.

6. A cigarette or cigar filler laminate, as defined in claim 1, wherein each of said plies of the laminate comprise a smooth side surface which smooth side surfaces of the plies are disposed adjacent to each other and adhered together at said spaced areas.

7. A cigarette or cigar filler laminate, as defined in claim 1, wherein said plies are reconstituted tobacco sheet made by the paper machine process wherein the tacky felt-side surfaces are disposed adjacent to each other and adhered together at said spaced areas.

8. A cigarette or cigar filler laminate, as defined in claim 1, wherein said plies comprise at least one of creped reconstituted tobacco sheet material.

9. A cigarette filler laminate, as defined in claim 1, wherein the laminate comprises two single sheets of reconstituted tobacco each approximatively 1/32 inch in width.

10. A process of making a tobacco filler as defined in claim 1, which comprises the steps of (a) forming a reconstituted tobacco sheet by applying a tobacco slurry mass on a supporting surface and drying the same, (b) removing the resultant dried tobacco sheet from the supporting surface, (c) laminating together pairs of dried tobacco sheet comprising spaced localized bonded and unbonded areas, and (d) cutting the laminate into shreds or threshing the laminate into sheet fragments to provide a tobacco filler having substantially improved filling power.

* * * * *